US010813390B2

(12) United States Patent
Joseph

(10) Patent No.: US 10,813,390 B2
(45) Date of Patent: Oct. 27, 2020

(54) SWIM SUIT, PARTICULARLY FOR COMPETITION SWIMMING

(71) Applicant: Arena Distribution S.A., Lugano (CH)

(72) Inventor: Michel Joseph, Lugano (CH)

(73) Assignee: Arena Italia S.p.A., Tolentino (IT)

( * ) Notice: Subject to any disclaimer, the term of this patent is extended or adjusted under 35 U.S.C. 154(b) by 101 days.

(21) Appl. No.: 15/116,301

(22) PCT Filed: Feb. 5, 2014

(86) PCT No.: PCT/EP2014/052229

§ 371 (c)(1),
(2) Date: Aug. 3, 2016

(87) PCT Pub. No.: WO2015/117646

PCT Pub. Date: Aug. 13, 2015

(65) Prior Publication Data

US 2017/0172224 A1 Jun. 22, 2017

(51) Int. Cl.
*A41D 7/00* (2006.01)

(52) U.S. Cl.
CPC ..... *A41D 7/005* (2013.01); *A41D 7/00* (2013.01); *A41D 2400/24* (2013.01); *A41D 2400/38* (2013.01); *A41D 2600/10* (2013.01)

(58) Field of Classification Search
CPC ..... A41D 7/00; A41D 7/005; A41D 7/001; A41D 2400/24; A41D 2400/38
See application file for complete search history.

(56) References Cited

U.S. PATENT DOCUMENTS 5,819,322 A * 10/1998 Dicker ..... A41D 13/0015 2/171.3
5,839,122 A * 11/1998 Dicker ..... A41D 7/00 2/67
6,047,406 A * 4/2000 Dicker ..... A41D 13/0015 2/115
8,533,864 B1 * 9/2013 Kostrzewski ..... A41D 13/0015 2/69
9,144,252 B1 * 9/2015 Kostrzewski ..... A41D 1/08
2006/0130215 A1 * 6/2006 Torry ..... A41D 1/08 2/227
2009/0038047 A1 * 2/2009 Di Lorenzo ..... A41D 7/005 2/67
2010/0205713 A1 * 8/2010 Takamoto ..... A41D 7/00 2/67

(Continued)

FOREIGN PATENT DOCUMENTS

EP 1 563 748 A1 8/2005
EP 2 206 441 A1 7/2010

(Continued)

*Primary Examiner* — Megan E Lynch
(74) *Attorney, Agent, or Firm* — Blank Rome LLP

(57) ABSTRACT

A swimsuit (1) has an outer shell (2) made of a flexible stretchable fabric and forms a tubular trunk portion (6) and two tubular thigh portions (7), the swimsuit (1) comprising two back stiffening lines (8) continuously connected to the outer shell (2) and extending each in a generally longitudinal direction of a one of the thigh portions (7) from a rear region (9) of the thigh portion (7) across a rear region of the trunk portion (6), in which said back stiffening lines (8) have a tensile stiffness greater than a tensile stiffness of said outer shell (2).

15 Claims, 3 Drawing Sheets

(56) References Cited

U.S. PATENT DOCUMENTS

Figure 1:
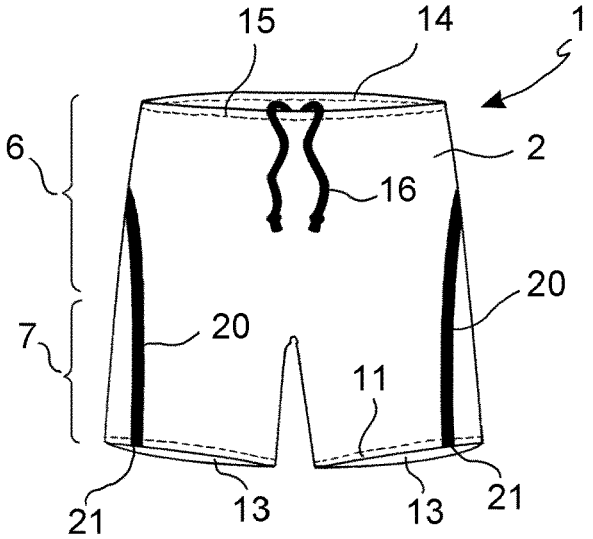

| | | | | |
|---|---|---|---|---|
| 2010/0281593 | A1* | 11/2010 | Aloy Font | A41D 1/08 2/22 |
| 2011/0009793 | A1* | 1/2011 | Lucero | A41D 13/0015 602/62 |
| 2011/0209267 | A1* | 9/2011 | Rush | A41D 1/08 2/228 |
| 2012/0036614 | A1 | 2/2012 | Meschter et al. | |
| 2012/0100778 | A1* | 4/2012 | Cho | A41D 1/06 450/95 |
| 2012/0255098 | A1* | 10/2012 | Leyva | A61H 36/00 2/69 |
| 2013/0095730 | A1* | 4/2013 | Jensen | A41C 1/003 450/95 |
| 2013/0305425 | A1* | 11/2013 | Zarabi | A41D 1/06 2/69 |
| 2013/0326785 | A1* | 12/2013 | Cornacchiari | A41D 13/0015 2/69 |
| 2014/0096301 | A1* | 4/2014 | Waller | A41D 7/00 2/67 |
| 2015/0201682 | A1* | 7/2015 | Musciacchio | A41D 7/005 2/67 |
| 2016/0129298 | A1* | 5/2016 | Sekula | A63B 21/0085 482/113 |

FOREIGN PATENT DOCUMENTS

| | | | | |
|---|---|---|---|---|
| GB | 2501396 | A * | 10/2013 | A63B 21/0552 |
| WO | WO-2010140502 | A1 * | 12/2010 | A41D 7/00 |
| WO | WO 2012164301 | A1 * | 12/2012 | A41D 7/00 |
| WO | WO 2014/016643 | A1 | 1/2014 | |

* cited by examiner

SWIM SUIT, PARTICULARLY FOR COMPETITION SWIMMING

The present invention relates, in general, to the field of sports garment. More particularly, it relates to swim suits or swim garments for water sports activities and particularly for competition swimming.

In the past years, in competitive swimming, very high levels of performance have been achieved thanks to evolved training methods and a specific nutrition which increasingly meet the requirements of the individual physical constitution of the athletes and of the swimming exercise to be performed.

On the other hand, in nearly all fields of sports and particularly in swimming, where the body of the athlete moves across a liquid, the efforts to enhance the performances increasingly focus on the development of sports garment which positively influences both the interaction of the athletes body surface with the environment and the physical conditions of the athlete during the competition or sports exercise and training.

The development of swim suits and garments focuses mainly on two principal goals, i.e. the reduction of friction between the external surface of the swim suit and the water and a hoop-compression of the muscular structure of the athlete in the region of the legs and body trunk.

In order to reduce the friction between the swimmer and the water, several stretchable fabrics with an extremely smooth and water repellent external surface texture (e.g. PTFE coated elastic textiles) have been proposed and successfully used.

The hoop-compression of the muscular structure of the swimmer has been aimed to by using swim suits made of stretchable garment material with a comparatively high coefficient of elasticity and by tailoring the swim suit such that the consequent stretching of the garment and resulting reaction hoop force result in a radial compression of the swimmer's body trunk and legs. The resulting muscular compression contributes to a better muscle alignment and reduces muscle vibration.

An exemplary swim suit made of a stretch fabric which addresses the needs of muscle compression, mechanical durability and wear resistance, as well as long term maintenance of the reversible stretch properties has been e.g. described in WO2014016643A of the same applicant.

Even though the known swimsuits provide generally satisfactory results, they still have some drawbacks. The strong compression applied by the stretch fabric of the swimsuit hinder obstruct or hinder the athlete's torso and legs to flex and move naturally. This is particularly applicable to competition swimmers during hip flexion when on the starting blocks, during turns off the wall and for the leg stroke of breaststrokers.

Due to the highly stretched condition of the swimsuit, the latter performs like a cage fitted on the swimmer's body. However, there is still a need for even more purposefully supporting the body position and posture in water in order to reduce fatigue, particularly towards the end of long distance swim events.

The object of the present invention is therefore to provide an improved swimsuit which better addresses at least some of the described needs.

These and other objects are achieved by a swimsuit according to the annexed claim 1. The dependent claims refer to advantageous embodiments of the invention.

According to an aspect of the invention, a swimsuit, particularly for competition swimming, comprises an outer shell suitable to cover at least part of the body trunk and of the thighs of a swimmer, wherein the outer shell is made of a flexible stretchable fabric adapted to apply a hoop compression to the thighs and to the body trunk, said outer shell forming a tubular trunk portion intended to cover a lower region of the torso of the swimmer and two tubular thigh portions connected with the trunk portion and intended to cover each an upper region of a respective thigh of the swimmer, characterized in that the swimsuit comprises two back stiffening lines continuously connected to said outer shell and extending each in a generally axial or longitudinal direction of a respective one of the thigh portions from a rear region of the thigh portion covering the posterior thigh muscles, across a rear region of the trunk portion covering the gluteus, said back stiffening lines having a greater tensile stiffness (expressed in N/cm) than a tensile stiffness of said outer shell.

Thanks to the back stiffening lines starting on the back of the leg and extending across the buttocks, during swimming "tension"-lines are created that contribute to lift the back of the legs while the swimmer is horizontal in the water. This lifting effect helps to keep the legs high in the water, to maintain a level and even body position and to avoid the upper legs lowering or dropping which is a major cause of drag in the water. The thus obtained lifting effect is particularly beneficial when the swimmer is fatigued near the end of a long distance event.

Additionally, the back stiffening lines also help to store and release kinetic energy when turning and accelerating off the wall and "exploding" off the starting blocks.

These and other features and advantages of the present invention shall be made apparent from the accompanying drawings which illustrate embodiments of the invention, and, together with the general description of the invention given above, and the detailed description of the embodiments given below, serve to explain the principles of the present invention.

Figure 2:
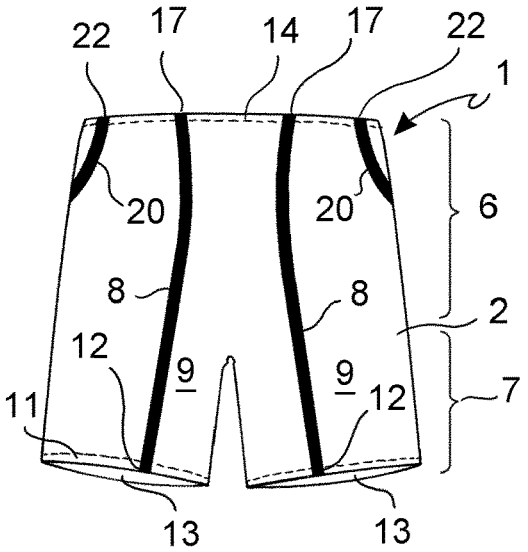
Figure 3:
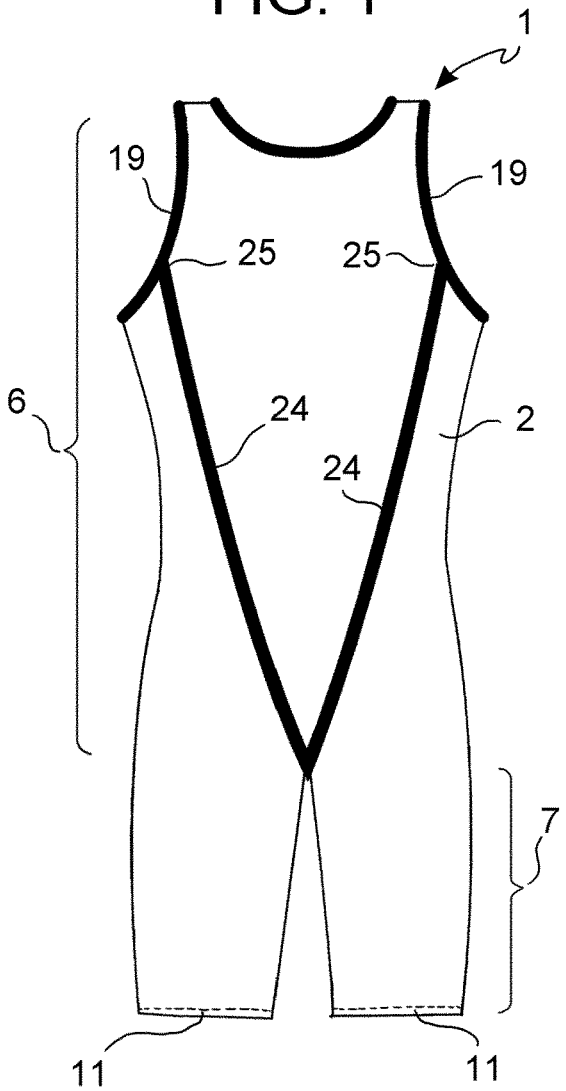
Figure 4:
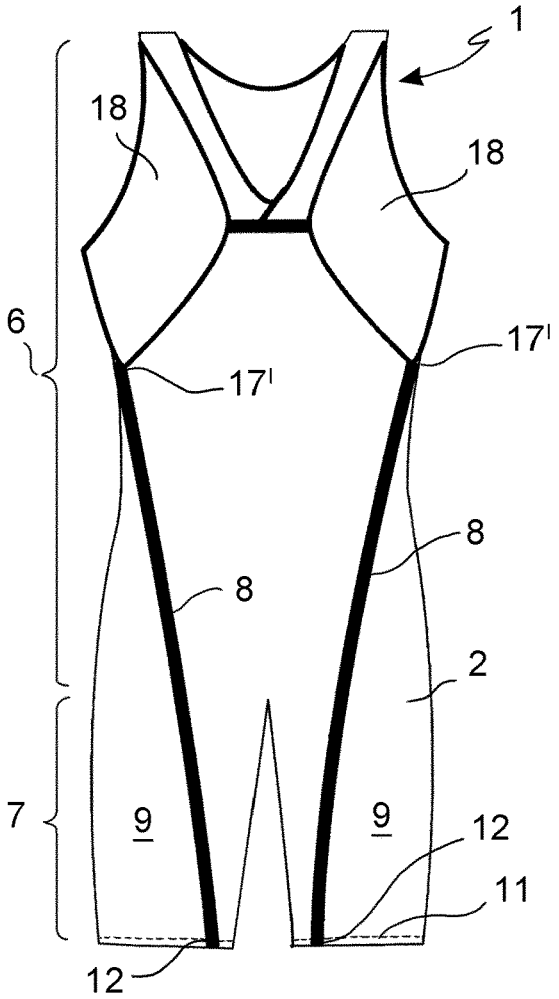
Figure 6:
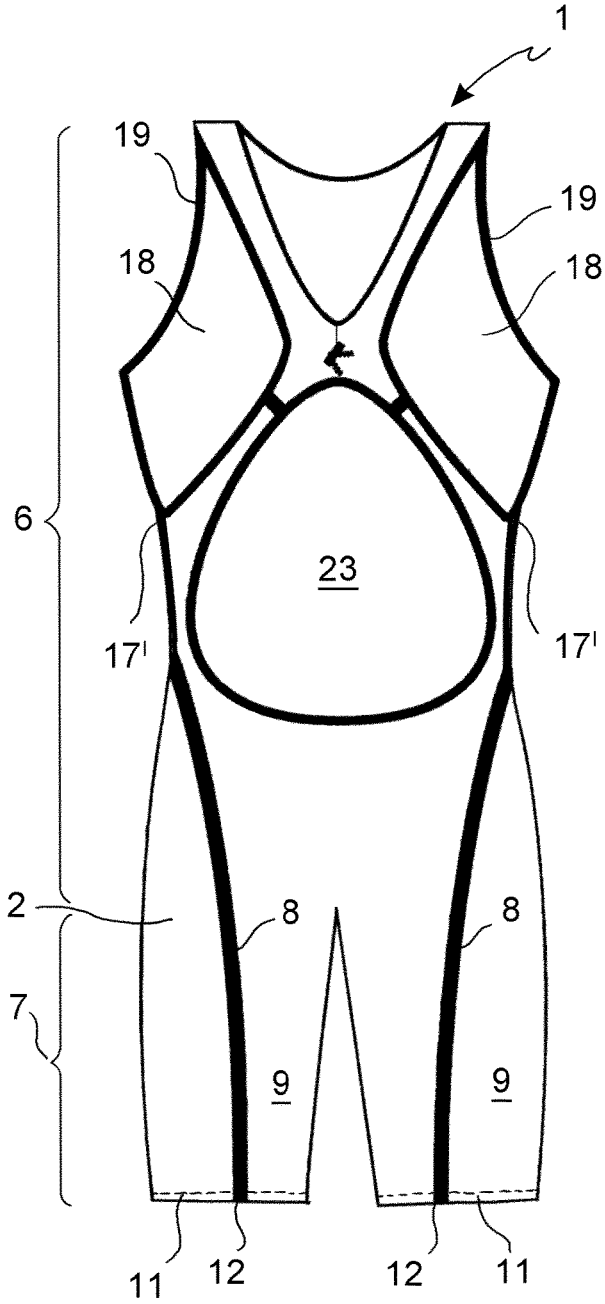
Figure 5:
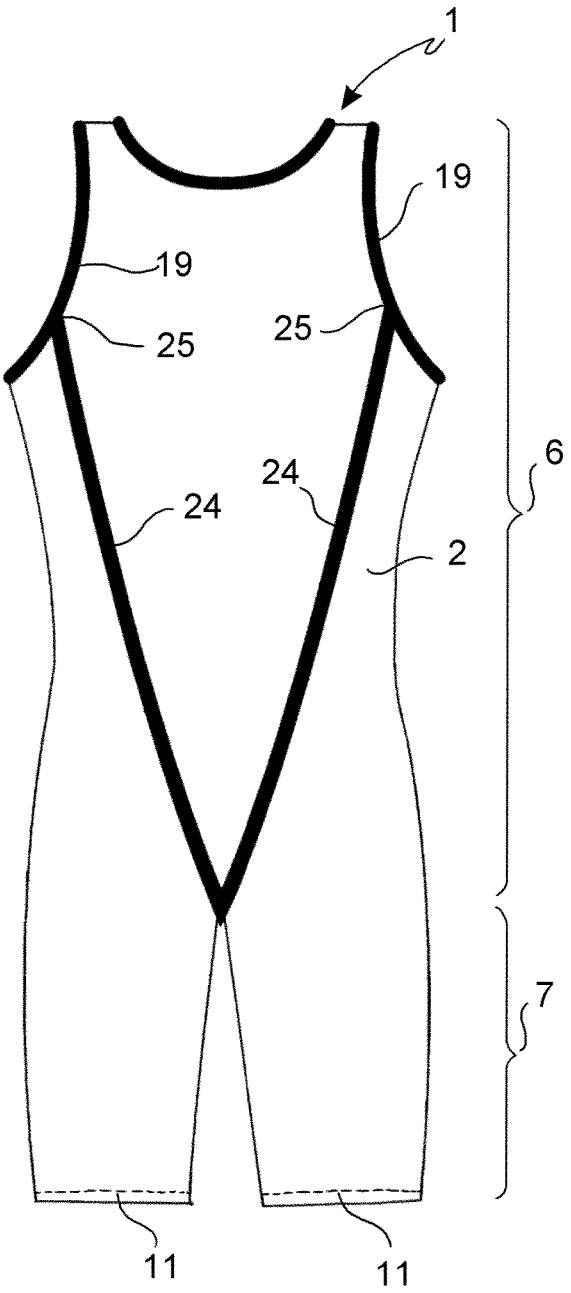
Figure 9:
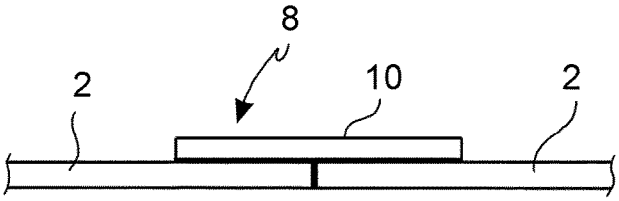
Figure 7:
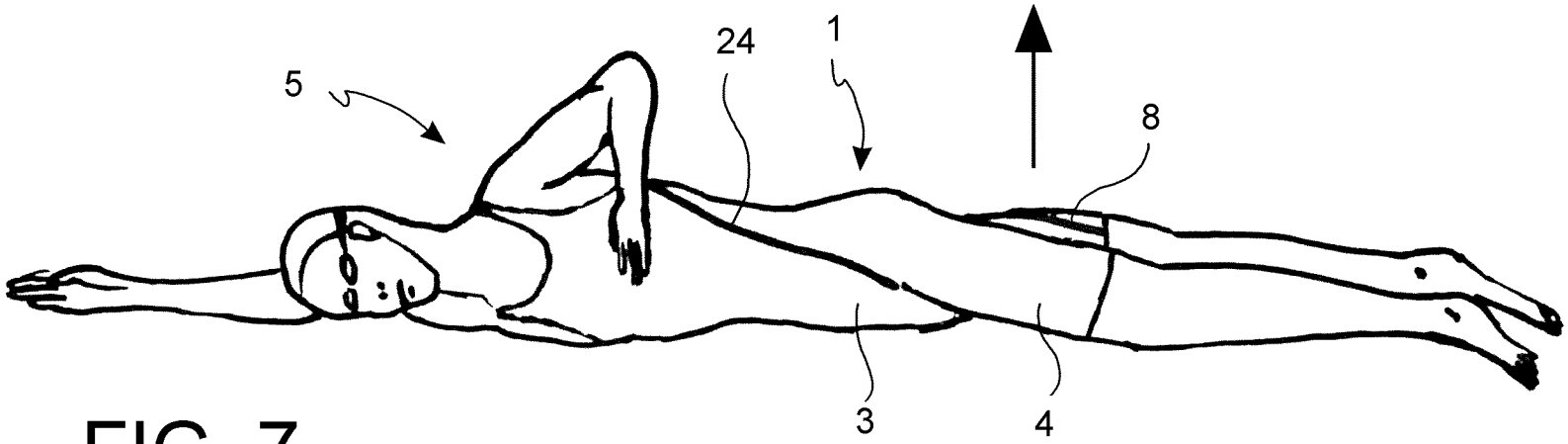
Figure 8:
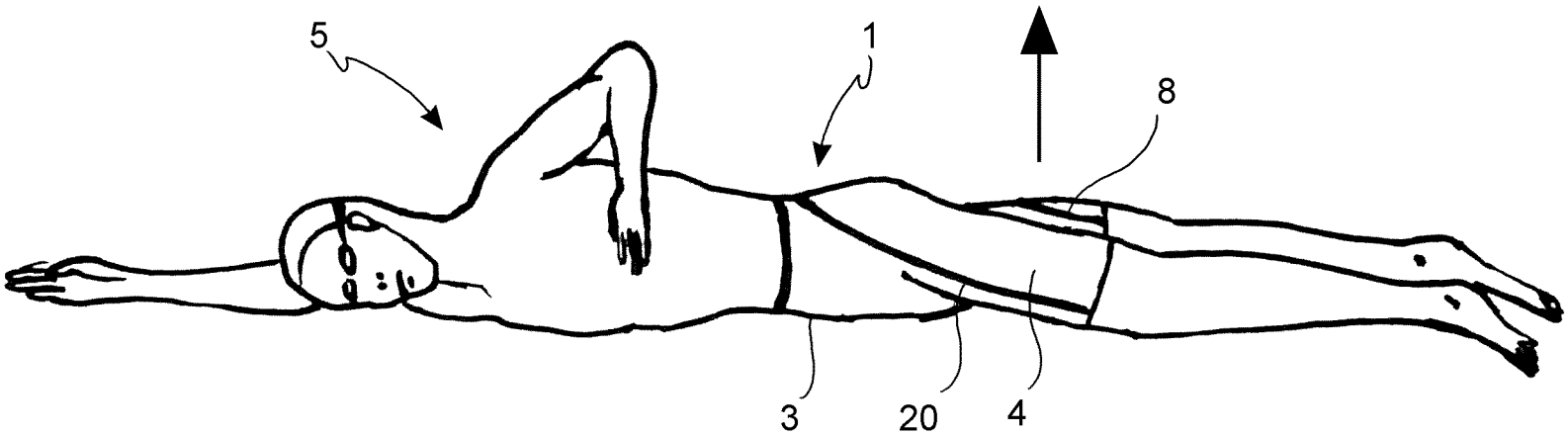

FIG. 1 illustrates a front view of a jammer style male swim suit according to an embodiment of the invention, FIG. 2 illustrates a rear view of the jammer style male swim suit in FIG. 1, FIG. 3 illustrates a front view of a tank-suit style one-piece female swim suit according to an embodiment of the invention, FIG. 4 illustrates a rear view of the tank-suit style one-piece female swim suit in FIG. 3, FIG. 5 illustrates a front views of a tank-suit style one-piece female swim suit with back opening according to an embodiment of the invention, FIG. 6 illustrates a rear view of the tank-suit style one-piece female swim suit with back opening in FIG. 5, FIGS. 7 and 8 show a female swimmer and a male swimmer wearing swimsuits in accordance with embodiments of the invention, FIG. 9 shows a cross-section of back stiffening lines and front flexion lines of the swimsuit in accordance with embodiments of the invention.

With reference to the figures, a swim suit is generally denoted by reference numeral 1.

The swimsuit 1, particularly for competition swimming, comprises an outer shell 2 suitable to cover at least part of the body trunk 3 and of the thighs 4 of a swimmer 5, wherein the outer shell 2 is made of a flexible stretchable fabric adapted to apply a hoop compression to the thighs and to the body trunk 3.

More specifically, the outer shell 2 forms a tubular trunk portion 6 intended to cover a lower region of the torso of the swimmer 5 and two tubular thigh portions 7 connected with the trunk portion 6 and intended to cover each an upper region of a respective thigh 4 of the swimmer 5.

In accordance with an aspect of the invention, the swimsuit 1 comprises two back stiffening lines 8 continuously connected to the outer shell 2 and extending each in a generally axial or longitudinal direction of a respective one of the thigh portions 7 from a thigh rear region 9 of the thigh portion 7, which in use covers the posterior thigh muscles, across a trunk rear region of the trunk portion, which in use covers the gluteus, and in which said back stiffening lines have a greater tensile stiffness than a tensile stiffness of said outer shell 2.

In the present description, the tensile stiffness of the back stiffening lines is intended as reaction force per unit width of fabric perpendicular to the direction of a given applied tensile strain, i.e. in the direction of the stiffening lines.

Thanks to the back stiffening lines 8 starting on the back of the leg and extending across the buttocks, during swimming "tension"-lines are created that contribute to lift the back of the legs while the swimmer is horizontal in the water. This lifting effect helps to keep the legs high in the water, to maintain a level and even body position and to avoid the upper legs lowering or dropping which is a major cause of drag in the water. The thus obtained lifting effect is particularly beneficial when the swimmer is fatigued near the end of a long distance event.

Additionally, the back stiffening lines 8 also help to store and release kinetic energy when turning and accelerating off the wall and "exploding" off the starting blocks.

In accordance with an embodiment (FIGS. 9, 10), the back stiffening lines 8 comprise a stripe of overlapped and bonded (e.g. glued), multiple layer (e.g. double layer) outer shell 2 fabric.

Additionally or alternatively the back stiffening lines 8 may comprise an additional tape 10 fastened externally or internally to the outer shell 2 fabric.

In this way a seam is created along the back stiffening lines 8 that has a significantly greater stretch resistance (or in other words significantly greater Young's modulus) than the outer shell 2 fabric panels which it joins and/or to which it is applied.

Advantageously, the glue and/or the tape 10 may have thermosetting properties and can be applied to the outer shell 2 fabric by means of heating and pressure.

In a further embodiment, an annular elastic leg band 11, preferably made from (or alternatively coated with) rubber elastic material or elastomeric material, e.g. silicone, is connected (e.g. bonded by gluing or heat sealing) to each of the thigh portions 11 in a manner to extend in contact with the skin around the respective legs of the swimmer 5. First (lower) ends 12 of the back stiffening lines 8 are arranged at and connected to the leg bands 11 which act as lower anchor points for the back stiffening lines 8.

Advantageously, the annular leg bands 11 are arranged to cover an outer shell 2 edge at leg openings 13.

In accordance with an embodiment of a male jammer type swimsuit (FIGS. 1, 2), the trunk portion 6 has an upper opening (trunk opening) 14 in the region of the waist of the wearer, provided with an annular waistband 15 which may have a drawstring 16 and which is lined or coated with rubber elastic material or elastomeric material, e.g. silicone, facing inside the swimsuit 1 to ensure its adherence and attachment to the skin.

Second (upper) ends 17 of the back stiffening lines 8 are arranged at and connected to the waist band 15 which act as upper anchor points for the back stiffening lines 8. Accordingly, the back stiffening lines 8 effectively define a "tension line" between respectively two anchor points or fixed points at the swimmer's body.

Additionally to the back stiffening lines 8, anterior-lateral flexion lines 20 may be provided which are continuously formed at the outer shell 2 and extending each in a generally axial or longitudinal direction of a respective one of the thigh portions 7 from a thigh anterior-lateral region 9 of the thigh portion 7, which in use covers the vastus lateralis muscle, and parallel to the hip flexor muscles across a trunk lateral region of the trunk portion 6, and in which along said anterior-lateral flexion lines 20 there is a local discontinuity of material properties with respect to the directly bordering outer shell 2 fabric.

The anterior-lateral flexion lines 20 may be embodied as described in relation with the back stiffening lines 8. The anterior-lateral flexion lines 20 run approximately parallel to the hip flexor muscles and are situated near the body's natural biomechanical plane of flex. The local discontinuity of the material properties "breaks" the outer shell 2 fabric in two distinct panels bordering along the flexion line 20. This allows the swimmer's legs to flex and to move naturally, without obstruction or hindrance being caused by the significant compression applied by the outer shell 2 stretch fabric.

In an embodiment, first (lower) ends 21 of the anterior-lateral flexion lines 20 are arranged at and connected to the leg bands 11 which assure a correct lower positioning of the anterior-lateral flexion lines 20. Analogously, second (upper) ends 22 of the anterior-lateral flexion lines 20 are arranged at and connected to the waist band 15 which assure a correct upper positioning of the anterior-lateral flexion lines 20.

To best conform with the wearers natural movement characteristics, the lower positioning point of the anterior-lateral flexion line 20 is placed in an anterior lateral region of the leg band 11 and the upper positioning point is placed in a posterior lateral region of the waist band 15, wherein the anterior lateral flexion line 20 extends in the entire thigh portion 7 in an anterior or anterior-lateral region and, in the trunk portion 6 from an anterior-lateral region thereof towards a posterior-lateral region, e.g. in a substantially S-shaped manner (FIGS. 1 and 2).

In accordance with an embodiment of a tank-suit style one-piece female swim suit (FIGS. 3, 4), the trunk portion 6 forms two upper arm/shoulder openings 18 in in a shoulder region of a wearer. An annular shoulder band 19, such as a binding tape or a stripe made from or coated with rubber elastic material or elastomeric material, e.g. silicone, is connected (e.g. bonded by gluing or heat sealing) with the arm/shoulder openings 18 and extends at least in a region under the arm and possibly all around the arm opening 19, e.g. from above the shoulders frontally downward under the arm and from there backward and upward along the shoulder blade region, as shown in FIGS. 3, 4 and 7.

Advantageously, the annular shoulder bands 19 are arranged to cover an outer shell 2 edge at arm openings 18.

In this embodiment, the second (upper) ends 17' of the back stiffening lines 8 are arranged at and connected to the respective shoulder bands 19 (in a position under the arm, as shown in the figures) which act as upper anchor points for the back stiffening lines 8. Accordingly, the back stiffening lines 8 effectively define a "tension line" between respectively two anchor points or fixed points at the swimmer's body.

In an embodiment of a tank-suit style one-piece female swim suit with back opening 23 (FIGS. 5 and 6), the second (upper) ends 17' of the back stiffening lines 8 may be arranged at and connected to the respective shoulder bands 19 (in a position under the arm, as shown in FIG. 6) which act as upper anchor points for the back stiffening lines 8. Additionally to the back stiffening lines, two anterior flexion lines 24 may be provided which are continuously formed at the outer shell 2 and which extend from a crotch region of the trunk portion 6 to an anterior lateral region thereof near the arm openings 18, thereby forming a "V" in the anterior region of the trunk portion 6. Also the anterior flexion lines 24 provide a local discontinuity of material properties with respect to the directly bordering outer shell 2 fabric.

Upper ends 25 of the anterior flexion lines 24 may be arranged at and connected to the respective shoulder bands 19 (in an anterior position as shown in FIG. 3).

The anterior flexion lines 24 may be embodied as described in relation with the back stiffening lines 8 and run across the hip flexor muscles, while being arranged along the body's natural biomechanical plane of flex. This allows the torso and legs to flex and move naturally, without obstruction or hindrance being caused by the significant compression which is applied by the outer shell 2 stretch fabric.

The described stiffening lines 8 and flexion lines 20, 24 are flexible, i.e. bendable, so they adapt to the shape of the body and move together with the body movements. By applying bonding tape 10 on the external side of the outer shell 2 along the back stiffening lines 8, the desired tension result along these lines can be further enhanced.

The advantages of the described swimsuit can be summarized as follows: The anterior flexion lines 24 in the female suit creates a flexline across the hip flexors and reduces restriction during hip flexions in starts, turns and breaststroke. The rear stiffening line 8 create tension lines between two defined anchor points and limits stretch between these points. The thus created tension lines have a lifting effect on the back of the legs that helps to keep the legs high in the water during freestyle, helps to prevent the knees from dropping during breaststroke (reducing drag), and helps to prevent the knees from dropping in the kick during butterfly.

The outer shell 2 can be made of a flexible stretchable fabric described in WO2014016643A whose content is herewith enclosed in its entirety for reference. The flexible stretchable fabric of the outer shell has a non-linear tensile stress-strain behavior with:

- a base strain range in which the tensile strain of the fabric is smaller than a transition strain value, and
- an overstrain range in which the tensile strain of the fabric is greater than the transition strain value, wherein a tensile modulus (Young's modulus which expresses the material stiffness in terms of the tensile stress required for a 100% elongation of the material, [N/mm$^2$]) of the fabric in the overstrain range is greater than a tensile modulus of the fabric in the base strain range.

In an embodiment, carbon fibers may be woven into the fabric.

In a further embodiment, additional reinforcement fibers (which may be carbon fibers or fibers made of a different material than carbon) are woven into the fabric in a multiple bent configuration such that:

- in a base strain range in which the tensile strain of the shell 2 fabric is smaller than a transition strain value, the reinforcement fibers bend or straighten out without elongation (and, hence, without, axial fiber stress and strain) and without substantially contributing to the tensile stiffness of the shell 2,
- in an overstrain range in which the tensile strain of the shell 2 fabric is greater than the transition strain value, the reinforcement fibers are elongated (with axial fiber stress and strain) and contribute to and increase the tensile stiffness of the shell 2 fabric compared to the base strain range.

The reinforcement fibers, particularly carbon fibers, woven into the stretch fabric of the outer shell 2 are stronger and stiffer than the base fibers, e.g. Lycra® fibers, of which the shell 2 fabric is made. Such additional stiffness provides an enhanced support to the athlete by a strong muscle compression which, however, can be provided to act only in response to shell stretch beyond the preset transition strain value. Accordingly, at a comparatively little stretched shell 2 of the swimsuit 1, the latter allows for easy stretch and movement and, at high stretch (e.g. due to maximum muscle contraction), the reinforcement fibers, particularly carbon fibers "lock out" the shell 2 fabric which becomes suddenly much stiffer and can accomplish the desired muscle compression. A thus embodied competition swimsuit reconciles the contrasting needs of freedom of movement and strong muscle compression during swimming.

In an exemplary non-limiting embodiment, the outer shell 2 fabric may contain:

- polyamide in a range of 45% to 58%, preferably about 52% by weight, and
- Elastane® in a range of 41% to 54%, preferably about 47% by weight, and
- carbon fibers in a range of 0,7% to 1,5%, preferably about 1% by weight.

The tapes placed along the stiffening lines may contain:

- polyamide in a range of 60% to 70%, preferably about 65% by weight, and
- Elastane® in a range of 29% to 39%, preferably about 34% by weight, and
- carbon fibers in a range of 0.7% to 1.5%, preferably about 1% by weight.

While the present invention has been illustrated by description of several embodiments and while the illustrative embodiments have been described in considerable detail, it is not the intention to restrict or in any way limit the scope of the appended claims to such detail. Additional advantages and modifications may readily appear to those skilled in the art.

The invention claimed is:

1. Swimsuit, particularly for competition swimming, comprising an outer shell made of a flexible stretchable fabric adapted to apply a hoop compression to the thighs and to the body trunk of a swimmer, wherein said outer shell forms a tubular trunk portion adapted to cover at least a lower region of the torso and waist of the swimmer, and two tubular thigh portions connected with the trunk portion and adapted to cover each an upper region of a respective thigh of the swimmer, said outer shell comprising an inner face which faces the torso of the swimmer and an outer face which faces away from the torso of the swimmer, wherein the swimsuit comprises two back stiffening means for creating tension lines in the swimsuit to lift the thigh of the swimmer when the swimmer is in a horizontal position in water and to prevent the thigh from dropping and causing drag in the water, wherein the back stiffening means stores and releases kinetic energy when the swimmer is turning and accelerating, the back stiffening means being fastened to the outer face of the outer shell, each back stiffening means having a constant width and extending in a substantially straight line between the waist and a center of the respective thigh of the swimmer, aligned in a generally longitudinal direction with the respective thigh, the two back stiffening means being connected and anchored to respective bands of the swimsuit at two opposing ends thereof and being continuously connected to the outer face of the outer shell and extending from a thigh rear region of the thigh portion, which in use covers the posterior thigh muscles, across a trunk rear region of the trunk portion, which in use covers the gluteus, the swimsuit further comprising an annular elastomeric leg band connected to each of the thigh portions of the swimsuit in a manner to extend in contact with the skin around the respective legs of the swimmer, wherein the two back stiffening means each extends to and connects to the annular elastomeric leg bands, the swimsuit further comprising anterior-lateral flexion lines continuously formed on the outer shell and extending each in a generally longitudinal direction of a respective one of the thigh portions from a thigh anterior-lateral region of the thigh portion, which, in use, covers the vastus lateralis muscle, and parallel to the hip flexor muscles across a trunk lateral region of the trunk portion, wherein said anterior-lateral flexion lines provide a local discontinuity of material properties with respect to the directly bordering outer shell fabric, in which lower ends of the anterior-lateral flexion lines are arranged at and connected to the leg bands, wherein the back stiffening lines and the anterior-lateral flexion lines do not intersect each other and are not intersected by any other stiffening bands or lines, except the annular leg bands.

2. Swimsuit according to claim 1, in which the two back stiffening means comprises two lines of tape having a tensile stiffness greater than a tensile stiffness of said outer shell, each line of tape comprising a stripe of overlapped and bonded multiple layer outer shell fabric.

3. Swimsuit according to claim 2, in which at least one of a binding glue and the two lines of tape have thermosetting properties and are applied to the outer shell fabric by means of heating and pressure.

4. Swimsuit according to claim 1, in which said annular elastomeric leg bands are made from or coated with silicone and bonded by glueing or heat sealing to each of the thigh portions.

5. Swimsuit according to claim 4, in which the annular leg bands are arranged to cover an outer shell edge at leg openings.

6. Swimsuit according to claim 1, tailored as a jammer, wherein the trunk portion has an upper opening in the region of the waist of the wearer, said upper opening being provided with an annular waist band coated with elastomeric material facing inside the swimsuit to ensure its adherence and attachment to the skin, wherein upper ends of the stiffening means are arranged at and connected to the waist band.

7. Swimsuit according to claim 1, in which upper ends of the anterior-lateral flexion lines are arranged at and connected to an annular waist band coated with elastomeric material facing inside the swimsuit to ensure its adherence and attachment to the skin.

8. Swimsuit according to claim 7, in which the lower end of the anterior-lateral flexion line is placed in an anterior lateral region of the leg band and the upper end is placed in a posterior lateral region of the waist band and the anterior lateral flexion line extends in the entire thigh portion in an anterior-lateral region and, in the trunk portion from an anterior-lateral region thereof towards a posterior-lateral region.

9. Swimsuit according to claim 1, tailored as a one-piece female tank-suit, wherein the trunk portion forms two upper arm openings provided with an annular shoulder band that extends all around the arm opening, wherein upper ends of the stiffening means are arranged at and connected to the respective shoulder bands in a position under the arm.

10. Swimsuit according to claim 1, tailored as a one-piece female tank-suit, wherein the trunk portion forms a back opening and two upper arm openings provided with an annular shoulder band that extends all around the arm opening, wherein upper ends of the stiffening means are arranged in a lateral region of the trunk portion, substantially at the height of a lower edge of the back opening.

11. Swimsuit according to claim 9, comprising two anterior flexion lines continuously connected to the outer shell and extending from a crotch region of the trunk portion to an anterior lateral region of the trunk portion near the arm openings, thereby forming a "V" in the anterior region of the trunk portion, wherein along said anterior flexion lines there is a local discontinuity of material properties with respect to the directly bordering outer shell fabric.

12. Swimsuit according to claim 11, wherein upper ends of the anterior flexion lines are arranged at and connected to the respective shoulder bands.

13. Swimsuit, particularly for competition swimming, comprising an outer shell made of a flexible stretchable fabric adapted to apply a hoop compression to the thighs and to the body trunk of a swimmer, wherein said outer shell forms a tubular trunk portion adapted to cover at least a lower region of the torso of the swimmer and two tubular thigh portions connected with the trunk portion and adapted to cover each an upper region of a respective thigh of the swimmer, said outer shell comprising an inner face which faces the torso of the swimmer and an outer face which faces away from the torso of the swimmer, wherein the swimsuit comprises two back stiffening means for creating tension lines in the swimsuit to lift the thigh of the swimmer when the swimmer is in a horizontal position in water and to prevent the thigh from dropping and causing drag in the water, wherein the back stiffening means stores and releases kinetic energy when the swimmer is turning and accelerating, the back stiffening means being fastened to the outer face of the outer shell, each back stiffening means extending in a generally straight, single line of constant width, aligned in a generally longitudinal direction with a respective one of the thigh portions of the swimmer, the two back stiffening means being continuously connected to the outer face of the outer shell and extending from a thigh rear region of the thigh portion, which in use covers the posterior thigh muscles, across a trunk rear region of the trunk portion, which in use covers the gluteus, the swimsuit further comprising an annular elastomeric leg band connected to each of the thigh portions of the swimsuit in a manner to extend in contact with the skin around the respective legs of the swimmer, wherein the two back stiffening means each extends to and connects to the annular elastomeric leg bands, in which the two back stiffening means comprises two lines of tape having a tensile stiffness greater than a tensile stiffness of said outer shell, each line of tape comprising a stripe of overlapped and bonded multiple layer outer shell fabric, in which at least one of a binding glue and the two lines of tape have thermosetting properties and are applied to the outer shell fabric by means of heating and pressure, in which said annular elastomeric leg bands are made from or coated with silicone and bonded by gluing or heat sealing to each of the thigh portions, in which the annular leg bands are arranged to cover an outer shell edge at leg openings, said swimsuit being tailored as a jammer, wherein the trunk portion has an upper opening in the region of the waist of the wearer, said upper opening being provided with an annular waist band coated with elastomeric material facing inside the swimsuit to ensure its adherence and attachment to the skin, wherein upper ends of the stiffening means are arranged at and connected to the waist band, further comprising anterior-lateral flexion lines continuously formed at the outer shell and extending each in a generally longitudinal direction of a respective one of the thigh portions from a thigh anterior-lateral region of the thigh portion, which in use covers the vastus lateralis muscle, and parallel to the hip flexor muscles across a trunk lateral region of the trunk portion, wherein said anterior-lateral flexion lines provide a local discontinuity of material properties with respect to the directly bordering outer shell fabric, in which lower ends of the anterior-lateral flexion lines are arranged at and connected to the leg bands and upper ends of the anterior-lateral flexion lines are arranged at and connected to said annular waist band, in which the lower end of the anterior-lateral flexion line is placed in an anterior lateral region of the leg band and the upper end is placed in a posterior lateral region of the waist band and the anterior lateral flexion line extends in the entire thigh portion in an anterior-lateral region and, in the trunk portion from an anterior-lateral region thereof towards a posterior-lateral region, wherein the back stiffening means and the anterior-lateral flexion lines do not intersect each other and are not intersected by any other stiffening bands or lines, except the annular waist band and the leg bands.

14. Swimsuit, particularly for competition swimming, comprising an outer shell made of a flexible stretchable fabric adapted to apply a hoop compression to the thighs and to the body trunk of a swimmer, wherein said outer shell forms a tubular trunk portion adapted to cover at least a lower region of the torso of the swimmer and two tubular thigh portions connected with the trunk portion and adapted to cover each an upper region of a respective thigh of the swimmer, said outer shell comprising an inner face which faces the torso of the swimmer and an outer face which faces away from the torso of the swimmer, wherein the swimsuit comprises two back stiffening means for creating tension lines in the swimsuit to lift the thigh of the swimmer when the swimmer is in a horizontal position in water and to prevent the thigh from dropping and causing drag in the water, wherein the back stiffening means stores and releases kinetic energy when the swimmer is turning and accelerating, the back stiffening means being fastened to the outer face of the outer shell, each back stiffening means extending in a generally straight, single line of constant width, aligned in a generally longitudinal direction with a respective one of the thigh portions of the swimmer, the two back stiffening means being continuously connected to the outer face of the outer shell and extending from a thigh rear region of the thigh portion, which in use covers the posterior thigh muscles, across a trunk rear region of the trunk portion, which in use covers the gluteus, the swimsuit further comprising an annular elastomeric leg band connected to each of the thigh portions of the swimsuit in a manner to extend in contact with the skin around the respective legs of the swimmer, wherein the two back stiffening means each extends to and connects to the annular elastomeric leg bands, in which the two back stiffening means comprises two lines of tape having a tensile stiffness greater than a tensile stiffness of said outer shell, each line of tape comprising a stripe of overlapped and bonded multiple layer outer shell fabric, in which at least one of a binding glue and the two lines of tape have thermosetting properties and are applied to the outer shell fabric by means of heating and pressure, in which said annular elastomeric leg bands are made from or coated with silicone and bonded by gluing or heat sealing to each of the thigh portions, in which the annular leg bands are arranged to cover an outer shell edge at leg openings, said swimsuit being tailored as a one-piece female tank-suit, wherein the trunk portion forms two upper arm openings provided with an annular shoulder band that extends all around the arm opening, wherein upper ends of the stiffening means are arranged at and connected to the respective shoulder bands in a position under the arm, comprising two anterior flexion lines continuously connected to the outer shell and extending from a crotch region of the trunk portion to an anterior lateral region of the trunk portion near the arm openings, thereby forming a "V" in the anterior region of the trunk portion, wherein along said anterior flexion lines there is a local discontinuity of material properties with respect to the directly bordering outer shell fabric, wherein upper ends of the anterior flexion lines are arranged at and connected to the respective shoulder bands, and lower ends of the anterior flexion lines are arranged at and connected to the leg bands, wherein the back stiffening means and the anterior flexion lines do not intersect each other and are not intersected by any other stiffening bands or lines, except the annular leg bands.

15. Swimsuit, particularly for competition swimming, comprising an outer shell made of a flexible stretchable fabric adapted to apply a hoop compression to the thighs and to the body trunk of a swimmer, wherein said outer shell forms a tubular trunk portion adapted to cover at least a lower region of the torso of the swimmer and two tubular thigh portions connected with the trunk portion and adapted to cover each an upper region of a respective thigh of the swimmer, said outer shell comprising an inner face which faces the torso of the swimmer and an outer face which faces away from the torso of the swimmer, wherein the swimsuit comprises two back stiffening means for creating tension lines in the swimsuit to lift the thigh of the swimmer when the swimmer is in a horizontal position in water and to prevent the thigh from dropping and causing drag in the water, wherein the back stiffening means stores and releases kinetic energy when the swimmer is turning and accelerating, the back stiffening means being fastened to the outer face of the outer shell, each back stiffening means extending in a generally straight, single line of constant width, aligned in a generally longitudinal direction with a respective one of the thigh portions of the swimmer, the two back stiffening means being continuously connected to the outer face of the outer shell and extending from a thigh rear region of the thigh portion, which in use covers the posterior thigh muscles, across a trunk rear region of the trunk portion, which in use covers the gluteus, the swimsuit further comprising an annular elastomeric leg band connected to each of the thigh portions of the swimsuit in a manner to extend in contact with the skin around the respective legs of the swimmer, wherein the two back stiffening means each extends to and connects to the annular elastomeric leg bands, in which the two back stiffening means comprises two lines of tape having a tensile stiffness greater than a tensile stiffness of said outer shell, each line of tape comprising a stripe of overlapped and bonded multiple layer outer shell fabric, in which at least one of a binding glue and the two lines of tape have thermosetting properties and are applied to the outer shell fabric by means of heating and pressure, in which said annular elastomeric leg bands are made from or coated with silicone and bonded by gluing or heat sealing to each of the thigh portions, in which the annular leg bands are arranged to cover an outer shell edge at leg openings, said swimsuit being tailored as a one-piece female tank-suit, wherein the trunk portion forms a back opening and two upper arm openings provided with an annular shoulder band that extends all around the arm opening, wherein upper ends of the stiffening means are arranged in a lateral region of the trunk portion, substantially at the height of a lower edge of the back opening, comprising two anterior flexion lines continuously connected to the outer shell and extending from a crotch region of the trunk portion to an anterior lateral region of the trunk portion near the arm openings, thereby forming a "V" in the anterior region of the trunk portion, wherein along said anterior flexion lines there is a local discontinuity of material properties with respect to the directly bordering outer shell fabric, wherein upper ends of the anterior flexion lines are arranged at and connected to the respective shoulder bands, wherein the back stiffening means and the anterior flexion lines do not intersect each other and are not intersected by any other stiffening bands or lines, except the annular leg bands.

* * * * *